US010519659B2

(12) United States Patent
Zavitz et al.

(10) Patent No.: US 10,519,659 B2
(45) Date of Patent: Dec. 31, 2019

(54) METHODS AND APPARATUSES FOR CONNECTING CONCRETE STRUCTURAL ELEMENTS

(71) Applicant: Tindall Corporation, Spartanburg, SC (US)

(72) Inventors: Bryant Zavitz, Dunwoody, GA (US); Kevin Kirkley, Dunwoody, GA (US); Behnam Naji, Atlanta, GA (US); Chris Sigmond, Atlanta, GA (US)

(73) Assignee: Tindall Corporation, Spartanburg, SC (US)

( * ) Notice: Subject to any disclaimer, the term of this patent is extended or adjusted under 35 U.S.C. 154(b) by 0 days.

(21) Appl. No.: 16/007,845

(22) Filed: Jun. 13, 2018

(65) Prior Publication Data

US 2018/0363290 A1 Dec. 20, 2018

Related U.S. Application Data

(60) Provisional application No. 62/519,043, filed on Jun. 13, 2017, provisional application No. 62/519,202, filed on Jun. 14, 2017.

(51) Int. Cl.
*E04C 5/10* (2006.01)
*E04B 1/41* (2006.01)

(52) U.S. Cl.
CPC ..... *E04C 5/10* (2013.01); *E04B 1/4121* (2013.01)

(58) Field of Classification Search
CPC ..... E04C 5/10; E04B 1/4121
See application file for complete search history.

(56) References Cited

U.S. PATENT DOCUMENTS 5,463,187 A * 10/1995 Battle ..... F16L 7/00 138/111
5,474,335 A * 12/1995 Sorkin ..... F16L 37/1205 285/309
5,775,849 A * 7/1998 Sorkin ..... E04C 5/10 285/322

(Continued)

OTHER PUBLICATIONS

International Search Report and Written Opinion, dated Oct. 24, 2018, in connection with International Application No. PCT/US2018/37384.

*Primary Examiner* — Andrew J Triggs
(74) *Attorney, Agent, or Firm* — Meunier Carlin & Curfman LLC

(57) ABSTRACT

Various implementations include methods and apparatuses for connecting concrete structural elements, such as pre-cast concrete structural elements. In one implementation, an apparatus includes a first concrete structural element into which a first duct is pre-cast, a second concrete structural element into which a second duct is pre-cast, and a duct coupler that couples the first duct in fluid communication with the second duct and prevents adhesive from flowing into the first or second duct when the first and second concrete structural elements are coupled together. In another implementation, a method of forming a concrete structural element includes disposing at least a portion of a duct within a form for receiving poured concrete, disposing a duct holder through an opening in the form and coupling the duct holder with the duct to hold the duct in position within the form during pouring, and removing the duct holder after the concrete hardens.

22 Claims, 9 Drawing Sheets

(56) References Cited

U.S. PATENT DOCUMENTS 5,954,373 A * 9/1999 Sorkin ..... E04C 5/10 285/312
6,389,764 B1 * 5/2002 Stubler ..... E01D 19/16 52/220.8
6,550,816 B1 * 4/2003 Sorkin ..... E04C 5/10 285/139.1
6,659,135 B2 * 12/2003 Sorkin ..... E04C 5/10 138/121
6,666,233 B1 * 12/2003 Sorkin ..... E04C 5/10 138/110
6,752,435 B1 * 6/2004 Sorkin ..... E01D 19/16 285/230
6,764,105 B1 * 7/2004 Sorkin ..... E04C 5/10 285/230
6,834,890 B2 * 12/2004 Sorkin ..... F16L 25/0018 285/230
6,874,821 B1 * 4/2005 Sorkin ..... E04C 5/10 285/230
7,267,375 B1 * 9/2007 Sorkin ..... E04C 5/10 285/245
7,273,238 B1 * 9/2007 Sorkin ..... F16L 21/022 277/616
7,621,103 B1 * 11/2009 Sorkin ..... E04C 5/10 405/259.1
7,686,347 B1 * 3/2010 Sorkin ..... E04C 5/10 285/226
7,695,021 B1 * 4/2010 Sorkin ..... E04C 5/10 285/226
8,398,123 B1 * 3/2013 Sorkin ..... E04C 5/10 285/369
9,399,869 B2 * 7/2016 Sorkin ..... E04C 5/12
9,423,059 B1 * 8/2016 Sorkin ..... E04C 5/10
9,493,951 B2 * 11/2016 Sorkin ..... E04C 5/00
9,695,964 B2 * 7/2017 Sorkin ..... E04C 5/00
9,803,788 B1 * 10/2017 Sorkin ..... F16L 37/02
9,879,804 B2 * 1/2018 Crigler ..... F16L 13/113
2007/0252389 A1 * 11/2007 Milici ..... E04C 5/10 285/369
2014/0367961 A1 * 12/2014 Crigler ..... E04C 5/10 285/230
2016/0010334 A1 * 1/2016 Sorkin ..... E04C 5/12 52/223.13
2017/0009916 A1 * 1/2017 Sorkin ..... E04C 5/00
2017/0227154 A1 * 8/2017 Sorkin ..... F16L 37/248
2017/0350126 A1 * 12/2017 Hunsicker ..... F16L 13/029
2018/0363290 A1 * 12/2018 Zavitz ..... E04B 1/4121

* cited by examiner

METHODS AND APPARATUSES FOR CONNECTING CONCRETE STRUCTURAL ELEMENTS

CROSS REFERENCE TO RELATED APPLICATIONS

This application claims priority to U.S. Application No. 62/519,043, entitled "Method and Apparatus for Connecting Concrete Structural Elements," filed Jun. 13, 2017, and U.S. Application No. 62/519,202, entitled "Method and Apparatus for Connecting Concrete Structural Elements," filed Jun. 14, 2017, the contents of which are herein incorporated by reference in their entireties.

BACKGROUND

Conventional methods and apparatuses for constructing a structure with pre-cast components including tendon ducts require labor intensive efforts to keep the tendon ducts clear while adjacent components are connected. Accordingly, a more efficient method and apparatus for connecting pre-cast components that include tendon ducts is desired.

BRIEF SUMMARY

Various implementations include an apparatus that comprises a first concrete structural element, a second concrete structural element, and a duct coupler. The first concrete structural element comprises a first duct that is pre-cast therein. The first duct has an end adjacent a second surface of the first concrete structural element, and at least a portion of a surface of the first duct adjacent the end comprises a first coupling portion. The second concrete structural element comprises a second duct that is pre-cast therein. The second duct has an end adjacent a first surface of the second concrete structural element. The first surface of the second concrete structural element and the first surface of the second concrete structural element face each other and are spaced apart, and the first and second surfaces of the second and first concrete structural elements define a joint therebetween. The duct coupler comprises an engagement portion. The engagement portion has a first end, a second end, and at least one wall extending between the first and second ends. A central axis of the duct coupler extends between the first and second ends. The at least one wall has an internal surface and an external surface, and the internal surface faces the central axis of the duct coupler and defines a channel that extends between openings defined by the first end and the second end of the duct coupler. At least a portion of the wall adjacent the first end of the duct coupler comprises a second coupling portion. The second coupling portion is coupled to the first coupling portion to couple the first duct and the duct coupler, and the second end of the engagement portion is disposed closer to the first surface of the second concrete structural element than the first end of the engagement portion.

In some implementations, the first and second ducts and the at least one wall are annular shaped.

In some implementations, the duct coupler further comprises a head portion that comprises an annular ring that has first and second annular surfaces. The first and second annular surfaces are axially spaced apart along a central axis of the annular ring. The first annular surface of the head portion is coupled to the second end of the engagement portion, the second annular surface of the head portion is coupled to the first surface of the second concrete structural element, an outer diameter of the annular ring is greater than an outer diameter of the second end of the engagement portion, and the central axis of the head portion is coaxial with the central axis of the channel of the engagement portion and central axes of the first and second ducts.

In some implementations, the first surface of the second concrete structural element and the second duct define an opening. The outer diameter of the annular ring is greater than a diameter of the opening, and the second annular surface of the head portion abuts the first surface of the second concrete structural element when the duct coupler is coupled to the first duct and extends through the joint.

In some implementations, the second annular surface of the head portion comprises a compressible material that abuts and creates a sealed interface against the first surface of the second concrete structural element.

In some implementations, the second annular surface of the head portion defines a groove that comprises a compressible material. The groove allows the compressible material radially adjacent the groove to compress when abutted against the first surface of the second concrete structural element and create a sealed interface between the head portion and the first surface of the second concrete structural element.

In some implementations, the head portion and the engagement portion are formed from different materials and coupled together.

In some implementations, the second coupling portion comprises one or more protrusions that extend radially inwardly from at least a portion of the internal surface of the annular shaped wall of the duct coupler, and the first coupling portion comprises one or more recesses defined by an external surface of the first duct. The one or more protrusions engage the one or more recesses.

In some implementations, the one or more protrusions are helical threads.

In some implementations, the second coupling portion comprises one or more protrusions that extend radially outwardly from at least a portion of the external surface of the annular shaped wall, and the first coupling portion comprises one or more recesses defined by an internal surface of the first duct, the one or more protrusions engaging the one or more recesses. For example, in some implementations, the one or more protrusions are helical threads.

In some implementations, the external surface of the annular shaped wall of the engagement portion tapers from the second end to the first end of the engagement portion such that a diameter of the external surface of the engagement portion at the second end is greater than a diameter of the external surface of the engagement portion at the first end.

In some implementations, a diameter of the internal surface of the annular shaped wall is constant.

In some implementations, the apparatus further comprises a splice duct. The splice duct has a first end and a second end that is axially spaced apart from the first end. The splice duct further comprises an internal surface that faces a central axis of the splice duct that extends between the first and second ends. The internal surface comprises a third coupling portion and a fourth coupling portion. The third coupling portion is adjacent the first end of the splice duct and engages the first coupling portion of the first duct, and the fourth coupling portion is adjacent the second end of the splice duct and engages the second coupling portion of the duct coupler. The first duct and the duct coupler are coupled via the splice duct, and the second end of the splice duct is closer to the facing surface of the first concrete structural element than the first end of the splice duct.

In some implementations, each of the first and second coupling portions comprises one or more protrusions that extend radially outwardly from an external surface of the first duct and the external surface of the duct coupler, respectively. Each of the third and fourth coupling portions comprise one or more recesses that are defined by the internal surface of the splice duct. The one or more protrusions of the first coupling portion engage the one or more recesses of the third coupling portion, and the one or more protrusions of the second coupling portion engage the one or more recesses of the fourth coupling portion.

In some implementations, the one or more protrusions are helical threads.

Various other implementations include a duct coupler for extending between a first duct that is pre-cast within a first concrete structural element and a second duct that is pre-cast within a second concrete structural element. The duct coupler comprises an engagement portion for coupling with the first duct. The engagement portion has a first end, a second end, and at least one wall extending between the first and second ends. A central axis extends between the first and second ends, and the at least one wall has an internal surface and an external surface. The internal surface faces the central axis and defines a channel that extends between openings defined by the first end and the second end, and at least a portion of the wall adjacent the first end comprises a coupling portion.

In some implementations, the at least one wall is an annular shaped wall.

In some implementations, the duct coupler further comprises a head portion that comprises an annular ring having a first annular surface and a second annular surface. The first and second annular surfaces are axially spaced apart along a central axis of the annular ring. The first annular surface of the head portion is coupled to the second end of the engagement portion, the second annular surface of the head portion is coupled to the first surface of the second concrete structural element, the central axis of the head portion is coaxial with the central axis of the channel of the engagement portion and central axes of the first and second ducts, and an outer diameter of the annular ring is greater than an outer diameter of the second end of the engagement portion.

In some implementations, the coupling portion comprises one or more protrusions that extend radially inwardly from at least a portion of the internal surface of the annular shaped wall. The one or more protrusions are for engaging one or more recesses defined on an external surface of the first duct.

In some implementations, the one or more protrusions are helical threads.

In some implementations, the coupling portion comprises one or more protrusions that extend radially outwardly from at least a portion of the external surface of the annular shaped wall. The one or more protrusions are for engaging one or more recesses defined by an internal surface of the first duct.

In some implementations, the one or more protrusions are helical threads.

In some implementations, the coupling portion comprises one or more protrusions that extend radially outwardly from at least a portion of the external surface of the annular shaped wall. The one or more protrusions are for engaging one or more recesses defined by an internal surface of a splice duct that is coupled to the first duct. In some implementations, the one or more protrusions are helical threads.

Various other implementations include a method of coupling a first concrete structural element and a second concrete structural element. The method comprises: (1) coupling a duct coupler with a first duct, the first duct being embedded in the first concrete structural element, wherein a surface of the first concrete structural element and the first duct define an opening; (2) disposing the surface of the first concrete structural element adjacent and facing a surface of the second concrete structural element such that the surfaces of the first and second concrete structural elements are spaced apart and define a joint therebetween; (3) urging the duct coupler in a second axial direction that is opposite the first axial direction until a second end of the duct coupler abuts a portion of the surface of the second concrete structural element, wherein the first end and the second end of the duct coupler are axially spaced apart and define a channel therebetween, the second concrete structural element comprising a second duct that is embedded therein, the second duct having an end adjacent the portion of the surface of the second concrete structural element, wherein the second duct defines a channel and the second duct and the portion of the surface of the second concrete structural element define an opening, the channel and the opening of the second duct being in fluid communication with the channel of the duct coupler and the opening and a channel of the first duct; and (4) filling the joint defined between the facing surfaces of the first and second concrete structural elements with an adhesive, the duct coupler preventing adhesive from flowing into the first and the second ducts.

In some implementations, the first duct comprises a first coupling portion, and the duct coupler comprises a second coupling portion adjacent a first end thereof. The second coupling portion is coupled to the first coupling portion by urging the first end and the second coupling portion of the duct coupler through the opening defined by the surface of the first concrete structural element in a first axial direction.

In some implementations, the first coupling portion comprises one or more recesses defined by an external surface of the first duct, and the second coupling portion comprises one or more protrusions that extend radially inwardly from an internal surface of the duct coupler.

In some implementations, the internal surface of the duct coupler is a radially internal surface of an annular shaped wall of the duct coupler. The one or more protrusions are helical threads, and the external surface of the first duct comprises helical threads that define the one or more recesses. The second coupling portion is threadingly engaged with the first coupling portion by rotating the duct coupler about the central axis in a first direction.

In some implementations, the first coupling portion comprises one or more recesses defined by an internal surface of the first duct, and the second coupling portion comprises one or more protrusions that extend radially outwardly from an external surface of the duct coupler.

In some implementations, the external surface of the duct coupler has a circular cross sectional shape as taken through a plane that is perpendicular to a central axis of the duct coupler, one or more protrusions are helical threads, and the internal surface of the first duct comprises helical threads that define the one or more recesses, wherein the second coupling portion is threadingly engaged with the first coupling portion by rotating the duct coupler about the central axis in a first direction.

In some implementations, a splice duct has a first end and a second end that is axially spaced apart from the first end of the splice duct. The splice duct further comprises an internal surface that faces a central axis of the splice duct that extends between the first and second ends. The internal surface of the splice duct comprises a third coupling portion and a fourth coupling portion. The third coupling portion is adjacent the first end of the splice duct and engages the first coupling portion of the first duct. The fourth coupling portion is adjacent the second end of the splice duct and engages the second coupling portion of the duct coupler. The first duct and the duct coupler are coupled via the splice duct, and the second end of the splice duct is adjacent the facing surface of the first concrete structural element.

In some implementations, each of the first and second coupling portions comprises one or more protrusions that extend radially outwardly from an external surface of the first duct and the external surface of the duct coupler, respectively. Each of the third and fourth coupling portions comprise one or more recesses that are defined by the internal surface of the splice duct. Coupling the duct coupler with the first duct comprises engaging the one or more protrusions of the first coupling portion with the one or more recesses of the third coupling portion and engaging the one or more protrusions of the second coupling portion with the one or more recesses of the fourth coupling portion.

In some implementations, the one or more protrusions are helical threads.

Various other implementations include a method of forming a concrete structural element into which a duct is pre-cast. The method comprises: (1) disposing at least a portion of a duct within a form for receiving poured concrete, the form defining a closed perimeter, and the duct having an end that is disposed adjacent a wall of the form, the wall of the form defining an opening therethrough, the opening having an axis that is coaxial with an axis of the duct; (2) disposing a first portion of a duct holder through the opening in the wall of the form such that a central axis of the first portion of the duct holder is coaxial with the axis of the duct; (3) coupling the first portion of the duct holder with the end of the duct such that a second portion of the duct holder abuts an external surface of the form adjacent the opening defined therein and prevents movement of the end of the duct within the form, the first and second portions of the duct holder being axially spaced apart; (4) pouring concrete into the form such that at least the duct is embedded within the concrete; and (5) removing the duct holder from the duct and the form after the concrete hardens.

In some implementations, the end of the duct abuts an internal surface of the wall of the form.

In some implementations, the first portion of the duct holder comprises an annular shaped wall.

In some implementations, an external surface of the duct adjacent the end of the duct comprises a first coupling portion, the first portion of the duct holder comprises an internal surface of the annular shaped wall of the duct holder, wherein the internal surface of the annular shaped wall comprises a second coupling portion, and the first and second coupling portions are engaged to couple the first portion of the duct holder with the end of the duct.

In some implementations, the first coupling portion comprises one or more recesses defined by the external surface of the duct adjacent the end of the duct, and the second coupling portion comprises one or more protrusions that extend radially inwardly from the internal surface of the annular shaped wall. The one or more protrusions engage the one or more recesses.

In some implementations, the one or more protrusions are helical threads, and the external surface of the duct comprises helical threads that define the one or more recesses. The helical threads of the duct holder are threadingly engaged with the helical threads of the duct.

In some implementations, an external surface of the annular shaped wall of the duct holder tapers away from the second portion of the duct holder such that a second end of the first portion of the duct holder that is coupled to the second portion of the duct holder has a diameter that is greater than a diameter of a first end of the first portion of the duct holder that is axially spaced apart from the second end of the first portion of the duct holder.

In some implementations, a diameter of the internal surface of the annular shaped wall of the duct holder between the first and second ends of the first portion of the duct holder is constant. In some implementations, an internal surface of the duct adjacent the end of the duct comprises a first coupling portion, the first portion of the duct holder comprises an external surface, wherein the external surface of the duct holder comprises a second coupling portion, and the first and second coupling portions are engaged to couple the first portion of the duct holder with the end of the duct.

In some implementations, the first coupling portion comprises one or more recesses defined by the internal surface of the duct adjacent the end of the duct, the second coupling portion comprises one or more protrusions that extend radially outwardly from the external surface of the duct holder, and the one or more protrusions engage the one or more recesses.

In some implementations, a cross-section of the first portion of the duct holder is circular, the one or more protrusions are helical threads, and the internal surface of the duct comprises helical threads that define the one or more recesses, wherein the helical threads of the duct holder are threadingly engaged with the helical threads of the duct.

In some implementations, the method further comprises coupling a first end of a splice duct with the end of the duct and disposing the splice duct and the duct within the form. The splice duct has a second end that is axially spaced apart from the first end of the splice duct, and the second end of the splice duct abuts an internal surface of the wall of the form. Coupling the first portion of the duct holder with the end of the duct comprises coupling the first portion of the duct holder with the second end of the splice duct.

In some implementations, the splice duct has an internal surface that defines a first coupling portion adjacent the first end of the splice duct and a second coupling portion adjacent the second end of the splice duct, the duct has an external surface that defines a third coupling portion for engaging the first coupling portion, and the first portion of the duct holder comprises an external surface that defines a fourth coupling portion for engaging the second coupling portion.

In some implementations, the first and second coupling portions comprise one or more recesses that are defined by the internal surface of the splice duct, the third coupling portion comprises one or more protrusions extending radially outwardly from the external surface of the duct, and the fourth coupling portion comprises one or more protrusions extending radially outwardly from the external surface of the duct holder.

In some implementations, the internal surface of the splice duct comprises helical threads that define the one or more recesses of the first and second coupling portions, the one or more protrusions of third coupling portion are helical threads that extend radially outwardly from the external surface of the duct, and the one or more protrusions of the fourth coupling portion are helical threads that extend radially outwardly from the external surface of the duct holder.

BRIEF DESCRIPTION OF THE DRAWINGS

These and other features, aspects, and advantages of the present disclosure will become apparent from the following description and the accompanying example implementations shown in the drawings, which are briefly described below.

DETAILED DESCRIPTION

Figure 1:
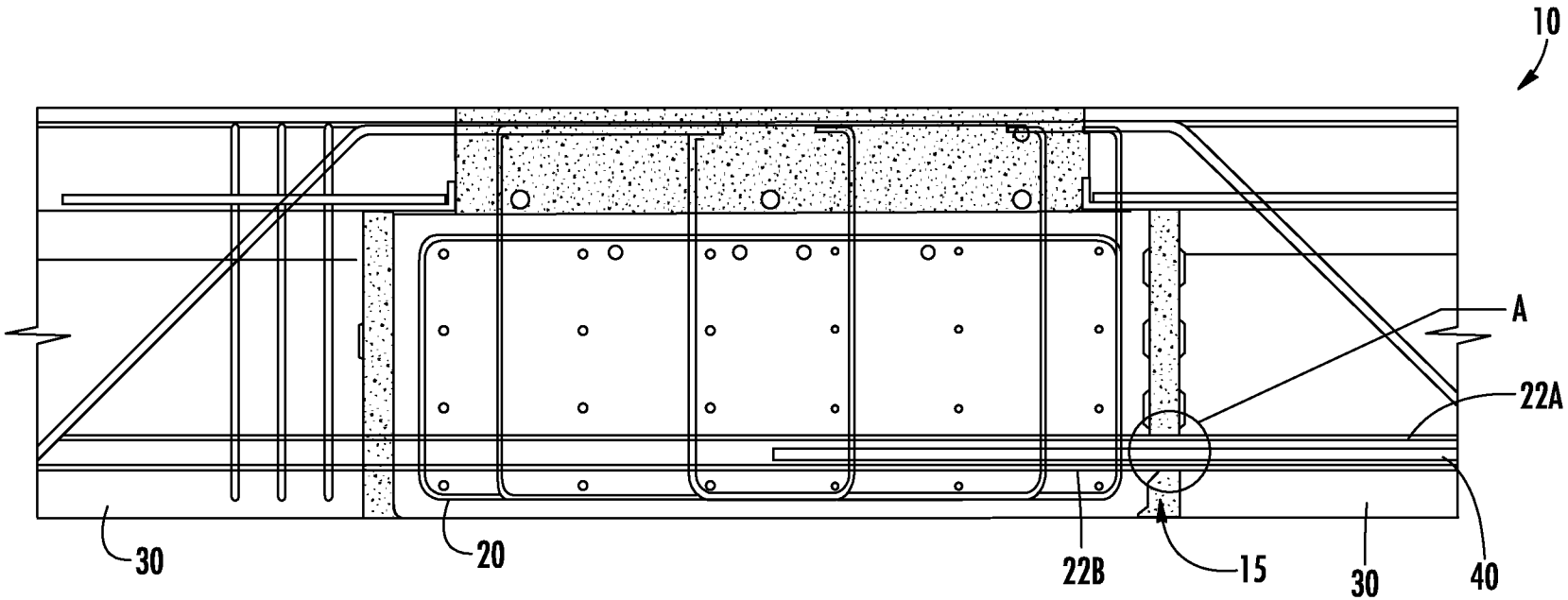
FIG. 1 illustrates a top view of a concrete structure including multiple pre-cast concrete structural elements according to one implementation.

Various implementations include methods and apparatuses for connecting concrete structural elements, such as pre-cast concrete structural elements. For example, in one implementation, an apparatus includes a first concrete structural element into which a first duct is pre-cast, a second concrete structural element into which a second duct is pre-cast, and a duct coupler that couples the first duct in fluid communication with the second duct and prevents adhesive from flowing into the first or second duct when the first and second concrete structural elements are coupled together. The concrete structural elements can be any pre-cast concrete structure. Non-limiting examples of concrete structures that may be used include beams, double tee beams, columns, blocks, and/or staves.

The first concrete structural element includes a first duct that is pre-cast therein. The first duct has an end adjacent a second surface of the first concrete structural element, and at least a portion of a surface of the first duct adjacent the end includes a first coupling portion 39.

The second concrete structural element includes a second duct pre-cast therein. The second duct has an end adjacent a first surface of the second concrete structural element. The first surface of the second concrete structural element and the second surface of the first concrete structural element face each other and are spaced apart, defining a joint therebetween.

The duct coupler includes an engagement portion and a head portion. The engagement portion includes a first end, a second end, and at least one wall extending between the first and second ends. A central axis of the duct coupler extends between the first and second ends, and the at least one wall has an internal surface and an external surface. The internal surface faces the central axis of the duct coupler and defines a channel that extends between openings defined by the first end and the second end of the duct coupler. At least a portion of the wall adjacent the first end of the duct coupler comprises a second coupling portion 53.

The head portion of the engagement portion includes an annular ring having a first annular surface and a second annular surface that are axially spaced apart from each other. The first annular surface is coupled to the second end of the engagement portion.

The first coupling portion and the second coupling portion are engaged to couple the first duct and the duct coupler. The facing surfaces of the first concrete structural element and the second concrete structural element are spaced apart such that the second annular surface of the head portion abuts the facing surface of the second concrete structural element adjacent the opening defined by the second duct and the facing surface of the second concrete structural element. Thus, when assembled, the second end of the engagement portion is disposed closer to the facing surface of the second concrete structural element than the first end of the engagement portion.

In some implementations, the coupling portions may comprise protrusions and/or recesses defined on radially adjacent surfaces of the duct coupler and the first duct that engage each other to prevent unintentional movement of the duct coupler relative to the first duct. For example, the protrusions and/or recesses may be defined by helical corrugations and/or helical threads.

Furthermore, to cast the concrete structural elements having ducts embedded therein, a duct holder may be engaged through an opening defined in a wall of a form to prevent movement of a duct disposed within the form while the concrete is being poured into the form. The duct holder includes a first portion that is engaged through the opening in the wall of the form. The first portion includes a surface that has a coupling portion that engages with a coupling portion of a surface of the duct (or a splice duct) disposed within the form. The coupling portions may comprise protrusions and/or recesses defined on radially adjacent surfaces of the duct holder and the first duct (or splice duct) that engage each other to prevent unintentional movement of the duct holder relative to the first duct, which prevents movement of the first duct within the form. For example, the protrusions and/or recesses may include helical corrugations and/or helical threads.

FIG. 1 illustrates an apparatus 10 according to one implementation. Apparatus 10 includes pre-cast concrete beam 20 and pre-cast concrete double tee beam 30. Tendon ducts 22B, 22A are pre-cast within beam 20 and the double tee beam 30 (e.g., in the stem portion of the double tee beam 30), respectively. In some implementations, rebar may be extended through the tendon ducts in adjacent concrete structural elements. And, in further implementations, adhesive may be added to the tendon ducts around the rebar. In one implementation, ducts 22A, 22B have helical corrugations formed on the internal and external surfaces thereof and may be formed of a stiff material, such as stiff metal or plastic material.

Adhesive is disposed within a joint 15 defined by facing surfaces 21, 31 of the beam 20 and double tee beam 30, respectively, to connect these surfaces 21, 31 together. In one implementation, the adhesive is a grout. To prevent the adhesive from flowing into the ducts 22A, 22B, a duct coupler is coupled between the opening 24A of the duct 22A of the double tee beam 30 and the opening 24B of the duct 22B of the beam 20 that face each other at the joint 15.

Figure 2:
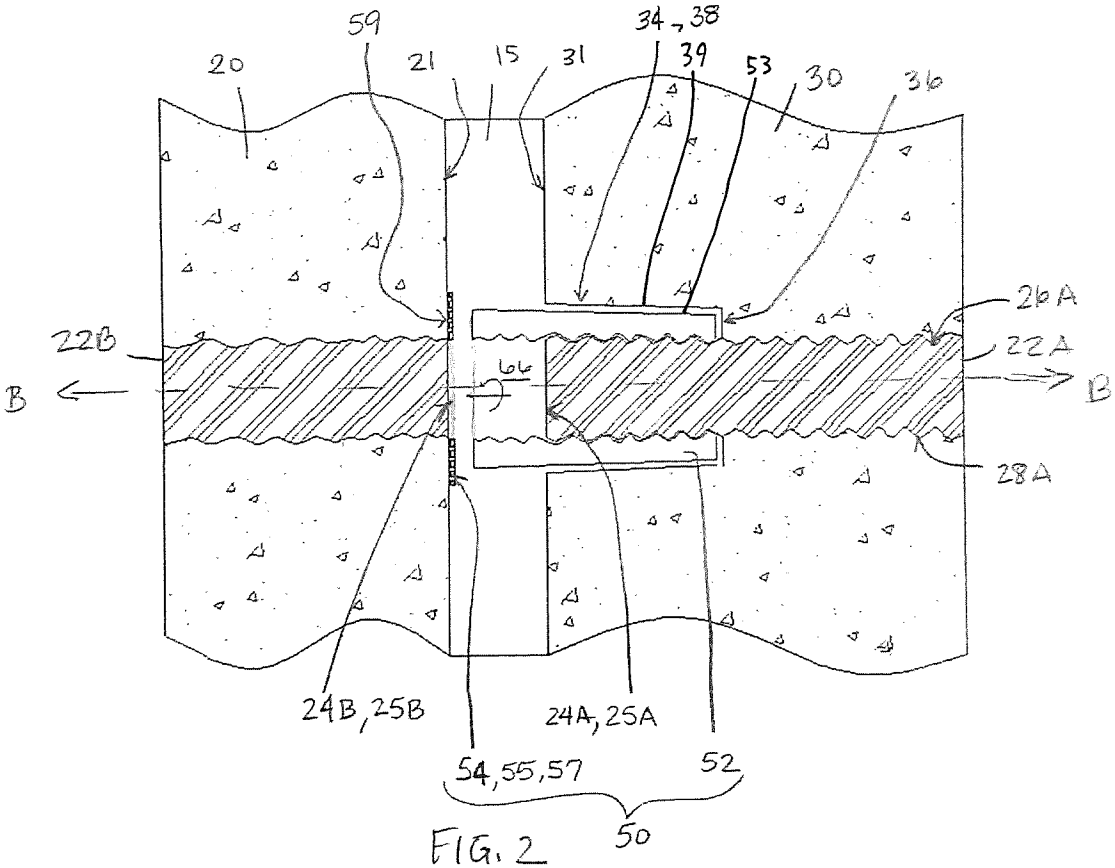
FIG. 2 illustrates a side cross sectional view of a duct coupler according to one implementation disposed within the joint between two pre-cast concrete structural elements as indicated at Section A in FIG. 1.
Figures 5A, 5B, 5C:
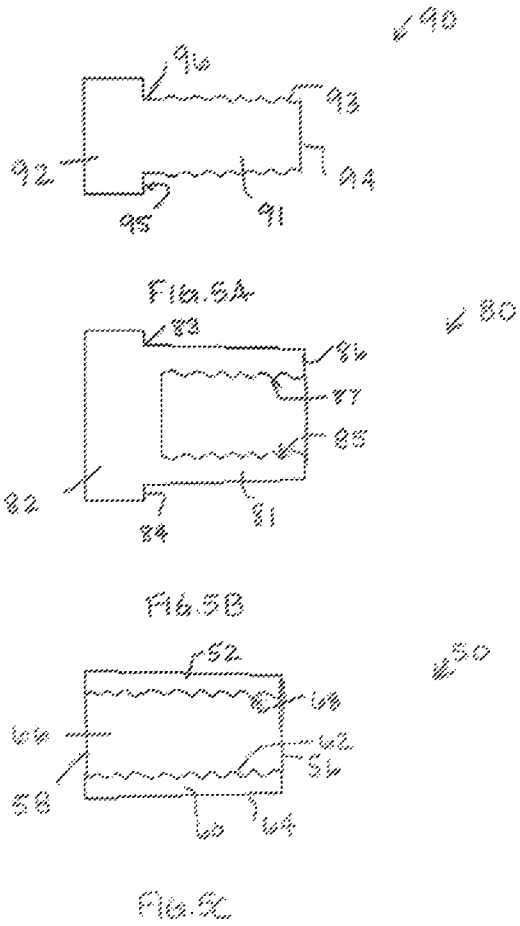
FIG. 5A illustrates the duct holder for the double tee beam shown in FIG. 3.
FIG. 5B illustrates the duct holder for the beam shown in FIG. 4.
FIG. 5C illustrates the duct coupler shown in FIG. 2.

FIGS. 2 and 5C illustrate one implementation of a duct coupler 50. Duct coupler 50 includes an engagement portion 52. The engagement portion 52 includes a first end 56, a second end 58, and an annular shaped wall 60 that extends between the first end 56 and the second end 58. A central axis B-B extends between the first 56 and second ends 58. The wall 60 includes an external surface 64 and an internal surface 62. The internal surface 62 faces the central axis B-B and defines a channel 66 that extends between openings defined by the ends 56, 58, and the external surface 64 faces radially away from the central axis B-B. Protrusions 68 extend radially inwardly from the internal surface 62. In this implementation, protrusions 68 are helical threads that extend circumferentially around the internal surface 62.

The external surface 28A of duct 22A defines recesses 26A adjacent the opening 24A of the duct 22A. For example, the external surface 28A of the duct 22A has helical corrugations that define recesses 26A. An end 25A of the duct 22A is within the same plane as the surface 31 of the double tee beam 30 and defines opening 24A. And, the surface 31 of the double tee beam 30 defines an annular channel 34 that extends axially into the double tee beam 30 and is radially adjacent a portion of the duct 22A that is adjacent the end 25A of the duct 22A.

To couple the engagement portion 52 of the duct coupler 50 with the duct 22A of the double tee beam 30, the protrusions 68 of the helical threads of the engagement portion 52 are threadingly engaged with the recesses 26A defined by the helical corrugations on the external surface 28A of the duct 22A by rotating the duct coupler 50 about axis B-B in a first direction. The first end 56 of the engagement portion 52 is adjacent an axially inner surface 36 of the channel 34, and the external surface 64 of the annular wall 60 is radially adjacent a radially inner surface 38 of the channel 34. For example, in some implementations, the first end 56 may abut the axially inner surface 36 of the channel 34 and/or the external surface 64 may abut the radially inner surface 38 of the channel 34. And, in other implementations, the first end 56 and the inner surface 36 may be spaced apart and the external surface 64 and the radially inner surface 38 may be spaced apart. The second end 58 and a portion of the wall 60 adjacent the second end 58 of the engagement portion 52 extend axially away from the channel 34 such that the second end 58 is disposed within the joint 15.

In addition, in the implementation shown in FIGS. 2 and 5C, the external surface 64 of the wall 60 of the engagement portion 52 tapers from the second end 58 to the first end 56 of the engagement portion 52 such that a diameter of the external surface 64 at the second end 58 of the engagement portion 52 is greater than a diameter of the external surface 64 of the first end 56 of the engagement portion 52. The inner diameter of the internal surface 62 of the engagement portion 52 is constant between the first end 56 and the second end 58. Similarly, an inner diameter of the channel 34 defined by the double tee beam 30 tapers from the surface 31 to the axially inner surface 36 of the channel 34. However, in other implementations, the external surface 64 of the wall 60 of the engagement portion 52 has a constant diameter.

In the implementation shown in FIG. 2, grease is applied to the external surface 28A of duct 22A adjacent the end 25A and/or to the internal surface 62 of the duct coupler 50 to ease the placement of the engagement portion 52 over the external surface 28A of the duct 22A.

The duct coupler 50 also includes a head portion 54. The head portion 54 includes an annular ring 55 having a first annular surface 57 and a second annular surface 59 that are axially spaced apart from each other. In the implementation shown in FIG. 2, the annular ring 55 is a gasket formed of a compressible material. For example, the compressible material may comprise a resiliently deformable material, such as a foam or an elastomeric material, such as rubber or synthetic rubber. Prior to pouring the adhesive in the joint, the head portion 54 is disposed between the surface 21 of the beam 20 that faces the surface 31 of the double tee beam 30 adjacent the opening 24B for duct 22B and the second end 58 of the engagement portion 52.

In the implementation shown in FIG. 2, the second annular surface 59 of the annular ring 55 is coupled to (e.g., using adhesive) the surface 21 of the beam 20, and the duct coupler 50 is rotated about its central axis B-B in a second direction opposite the first direction until the second end 58 of the engagement portion 52 abuts the first annular surface 57 of the annular ring 55. In this implementation, the axis B-B of the channel 66 of the duct coupler 50 is coaxial with the axis extending through the duct 22A and with the duct 22B.

Because the annular ring 55 comprises a compressible material, the interface between the annular ring 55, the engagement portion 52, and the surface 21 of the beam 20 is sealed. And, the interface between the internal surface 62 of the engagement portion 52 and the external surface 28A of the duct 22A is sealed. Thus, adhesive poured into the joint 15 between surfaces 21, 31 cannot flow into the ducts 22A, 22B. In other implementations, the first annular surface 57 of the annular ring 55 may be coupled to the second end 58 of the engagement portion 52 before rotating the duct coupler 50 in the second direction.

In the implementation shown in FIGS. 2 and 5C, the surfaces of the ducts 22A, 22B have helical corrugations and the internal surface 62 of the engagement portion 52 has helical threads, but in other implementations, the surfaces may have annular corrugations and/or threads or semi-annular corrugations and/or threads, corrugations and/or threads that extend from an internal or external surface of the duct or engagement portion, or the surfaces may define one or more recesses or protrusions for engaging a corresponding protrusions or recesses in the mating surface, or the surfaces may be smooth.

In some implementations, at least a portion of the duct coupler 50 comprises a compressible material, which allows for some deformation of duct coupler 50 as the duct coupler 50 is coupled with the surface 21 of the beam 20 and the external surface 28A of the duct 22A to ensure a seal with the duct coupler 50 and the duct 22A and beam 20. For example, in one implementation, the duct coupler 50 may be made of polyurethane.

In addition, in some implementations, the second annular surface 59 of the annular ring 55 of the head portion 54 may define a groove. The groove may receive a seal formed of a compressible material for engaging the surface 21 of the beam 20, or the groove may allow the compressible material to spread radially when abutted against the surface 21 of the beam 20 when the second annular surface 59 defining the groove is made of a compressible material.

Figure 3:
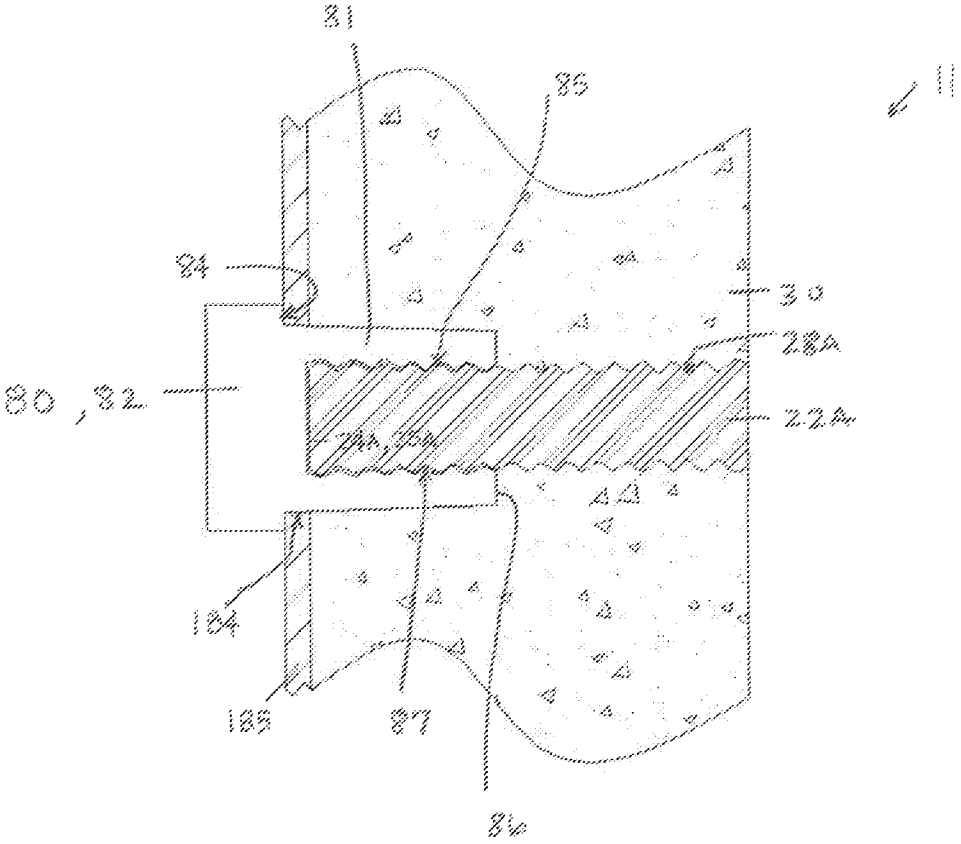
FIG. 3 illustrates a side cross sectional view of a casting apparatus according to one implementation for forming the portion of the concrete double tee beam element included in Section A in FIG. 1.

To form the channel 34 defined by the double tee beam 30 into which the engagement portion 52 of the duct coupler 50 is received, a duct holder may be inserted into a form into which concrete is poured for pre-casting the double tee beam 30. FIGS. 3 and 5B illustrate a casting apparatus 11 for forming the double tee beam 30 with the duct 22A pre-cast therein, according to one implementation. The casting apparatus 11 includes a duct holder 80 and a form 185 defining a closed perimeter. The duct holder 80 includes a first portion 81 and a second portion 82. The first portion 81 includes an annular wall that has an internal surface 85 from which one or more protrusions 87 extend. The protrusions 87 engage recesses 26A defined on an external surface 28A of the duct 22A. For example, the protrusions 87 are helical threads, and the recesses 26A are defined by helical threads (e.g., helical corrugations) defined on the external surface 28A of the duct 22A. The second portion 82 has a first surface 84 that is coupled to a second end 83 of the first portion 81. An outer diameter of an external surface of the first portion 81 tapers from the second end 83 of the first portion 81 toward a first end 86 of the first portion 81. An inner diameter of an internal surface of the first portion 81 is constant.

The second portion 82 of the duct holder 80 shown in FIG. 3 is cylindrical, and a first surface 84 of the second portion 82 is coupled to the second end 83 of the first portion 81. An outer diameter of the second portion 82 is greater than an inner diameter of an opening 184 in a wall of the form 185. Prior to forming the double tee beam 30, the first end 86 of the duct holder 80 is urged through the opening 184 in the wall of the form 185, and the first surface 84 of the second portion 82 is urged against an external surface of the wall of the form 185. The end 25A of the duct 22A is engaged with the first end 86 of the duct holder 80 by threadingly engaging the protrusions 87 with the recesses 26A defined by the duct 22A. Then, concrete is poured in the form 185 around the duct holder 80 and duct 22A and allowed to harden such that the concrete structural element holds its form after being removed from the form 185. Once hardened, the duct holder 80 is threadingly disengaged from the duct 22A and is urged out of the opening 184. The space occupied by the first portion 81 creates the channel 34 for receiving the engagement portion 52 of the duct coupler 50 described above. And, duct holder 80 holds the duct 22A at the proper location within the double tee beam 30 during the casting process.

Figure 4:
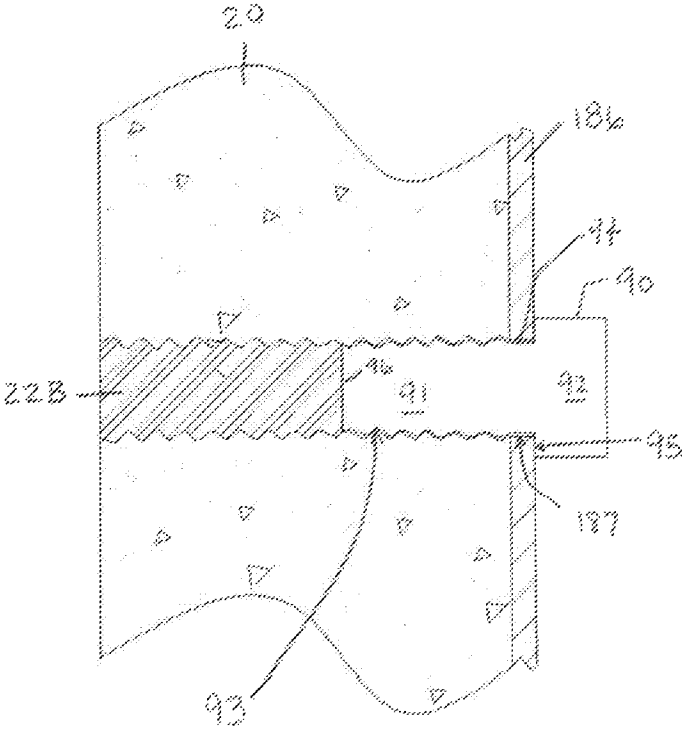
FIG. 4 illustrates a side cross sectional view of a casting apparatus according to one implementation for forming the portion of the concrete beam element included in Section A in FIG. 1.

Similarly, FIGS. 4 and 5A illustrate a casting device 12 according to another implementation. The casting device 12 may be used to form the beam 20 and prevent movement of the duct 22B within the mold while forming the beam 20 is being formed. Casting device 12 includes a duct holder 90 and a form 186 that forms a closed perimeter. The duct holder 90 includes a first portion 91 and a second portion 92. An external surface 93 of the first portion 91 includes one or more protrusions that extend radially outwardly therefrom. The second portion 92 has an outer diameter that is greater than an outer diameter of the first portion 91. A first surface 95 of the second portion 92 is coupled to a second end 96 of the first portion 91.

In use, a first end 94 of the first portion 91 is urged through an opening 187 defined in a wall of the form 186, and the protrusions that extend from the external surface 93 of the first portion 91 threadingly engage recesses defined by an internal surface of the duct 22B. For example, the duct 22B may be a helical corrugated duct. The first surface 95 of the second portion 92 abuts an external surface of the wall of the form 186. Concrete is poured in the form 186 around the duct holder 90 and duct 22B and allowed to harden such that the concrete structural element holds its form after being removed from the form 186. Once hardened, the duct holder 90 is disengaged from the duct 22B and urged out of the opening 187, and the beam 20 is removed from the form 186.

Figure 6:
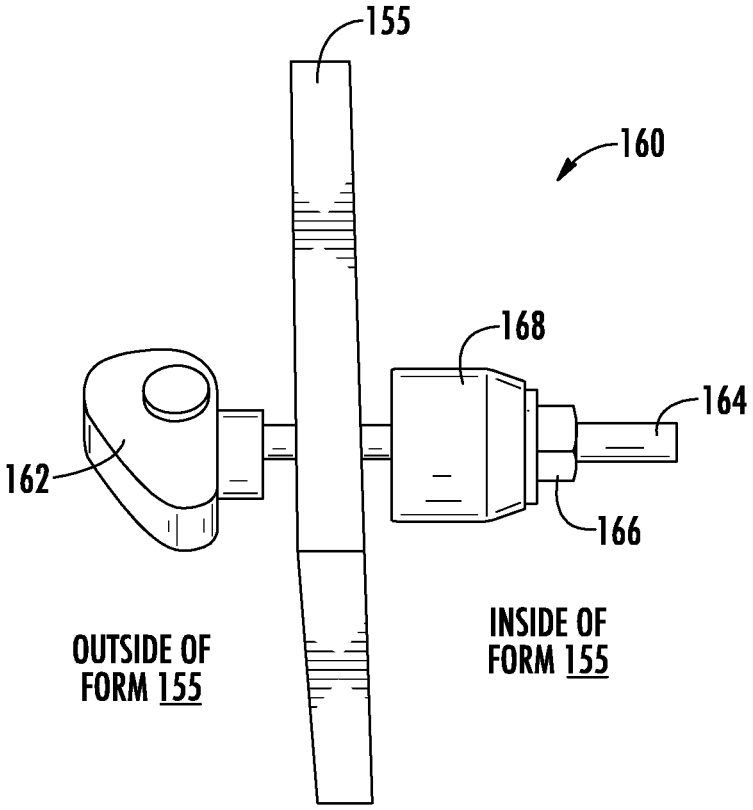
FIG. 6 illustrates a duct holder according to another implementation.

FIG. 6 illustrates an alternative implementation of a duct holder 160 that can be used with straight walled (or corrugated walled) ducts. Duct holder 160 includes a tightening portion 162 (e.g., a cam shaft) on an outside of a form wall 155 (only a portion is shown), bolt 164 that runs through a hole in the form wall 155 into the inside of the form to support the duct (not shown), nut 166 on the end of bolt 164, and a resiliently deformable portion 168 surrounding bolt 164 adjacent the nut 166. The duct holder 160 is assembled on the wall of the form wall 155, and then the duct is placed over the end of the resiliently deformable portion 168. The tightening portion 162 is rotated to draw nut 166 toward the form wall 155, which squeezes the resiliently deformable portion 168 between the nut 166 and the form wall 155, causing the resiliently deformable portion 168 to increase in diameter. The tightening portion 162 is rotated until the resiliently deformable portion 168 has increased in diameter enough to engage the internal surface of the duct. In one implementation, the resiliently deformable portion 168 comprises a foam or an elastomeric material, such as rubber or synthetic rubber. After the concrete is poured in the form and hardens, the tightening portion 162 is loosened, which allows the resiliently deformable portion 168 to return to its pre-compressed diameter, allowing the duct holder 160 and the completed concrete piece to be removed from the form.

Figure 7:
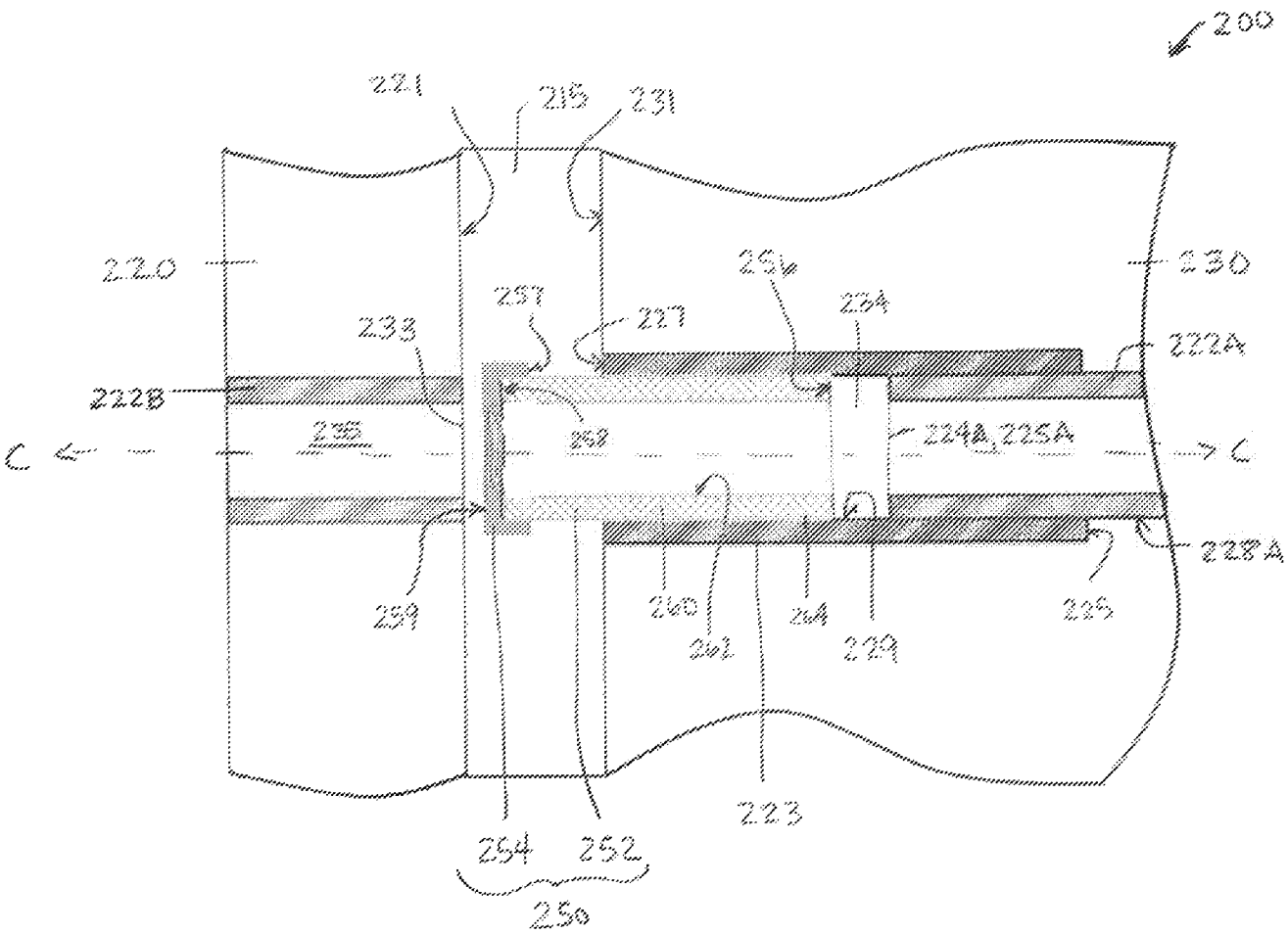
FIG. 7 illustrates a side cross sectional view of a duct coupler according to another implementation disposed within the joint between two pre-cast concrete structural elements.

FIG. 7 illustrates a partial view of an apparatus 200 according to another implementation. The apparatus includes duct 222A embedded within a first concrete structural element 230, a duct 222B embedded within a second concrete structural element 220, and a duct coupler 250. Facing surfaces 231, 221 of the first 230 and second concrete structural elements 220, respectively, are spaced apart and define a joint 215 therebetween. The duct 222B and the facing surface 221 of the second concrete structural element 220 define an opening 233 to a channel 235 of the duct 222B. The duct coupler 250 includes an engagement portion 252 and a head portion 254. The engagement portion 252 includes a first end 256, a second end 258, and an annular shaped wall 260 that extends between the first end 256 and the second end 258. A central axis C-C extends between the first 256 and second ends 258. The wall 260 includes an external surface 264 and an internal surface 262. The internal surface 262 faces the central axis C-C and defines a channel 266 that extends between openings defined by the ends 256, 258, and the external surface 264 faces radially away from the central axis C-C. Protrusions 268 extend radially outwardly from the external surface 264. In this implementation, protrusions 268 are helical threads. Unlike the implementation shown in FIGS. 2 and 5C, the external surface 264 of the engagement portion 252 of the duct coupler 250 has a constant diameter between the first end 256 and the second end 258.

A splice duct 223 that is pre-cast within the first concrete structural element 230 couples the duct coupler 250 with the duct 222A. The splice duct 223 includes a first end 225 and a second end 227. The first end 225 of the splice duct 223 is disposed in a plane that includes the surface 231 of the first concrete structural element 230, and the second end 227 of the splice duct 223 is axially spaced apart from the first end 225 and disposed within the first concrete structural element 230. The end 224A of the duct 222A is coupled with the first end 225 of the splice duct 223. As shown, an internal surface 229 adjacent the first end 225 of the splice duct 223 defines helical threads (e.g., helical corrugations) that engage an external surface 228A adjacent the end 224A of the duct 222A. The engagement of the splice duct 223 with the duct 222A occurs prior to forming the first concrete structural element 230 such that the splice duct 223 and the duct 222A are pre-cast within the first concrete structural element 230. The internal surface 229 of splice duct 223 also defines helical threads (e.g., helical corrugations) adjacent the second end 227 of the splice duct 223.

To couple the engagement portion 252 of the duct coupler 250 with the splice duct 223, the first end 256 of the engagement portion 252 and the portion of the annular wall 260 adjacent the first end 256 are axially urged through a channel 234 defined by the splice duct 223 and are threadingly engaged with the splice duct 223 by rotating the engagement portion 252 in a first direction about axis C-C. The engagement of the protrusions 268 of the duct coupler 250 with the recesses 226 of the splice duct 223 prevent unintended axial movement of the duct coupler 50 relative to the splice duct 223 and the duct 222A. The second end 258 of the duct coupler 250 and a portion of the wall 260 adjacent the second end 258 of the engagement portion 252 extend axially away from the channel 234 of the splice duct 223 such that the second end 258 is disposed in a plane that is spaced apart from the surface 231 of the first concrete structural element 230. However, in other implementations, the second end 258 and the portion of the wall 260 adjacent the second end 258 are disposed within the channel 234.

Figure 8:
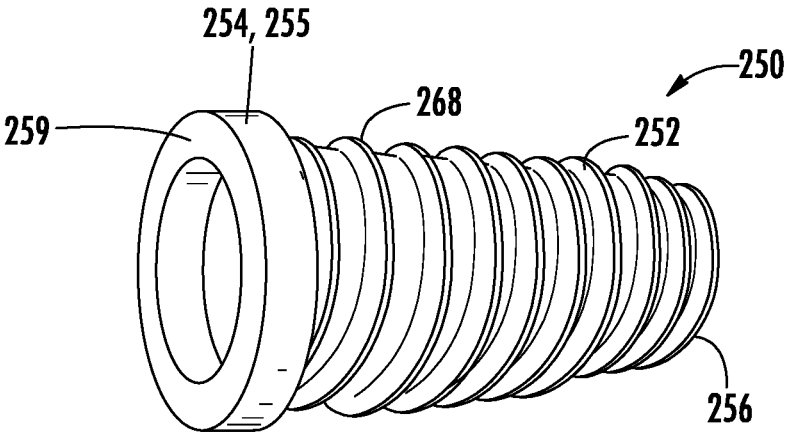
FIG. 8 illustrates a side perspective view of the duct coupler shown in FIG. 7.
Figure 9:
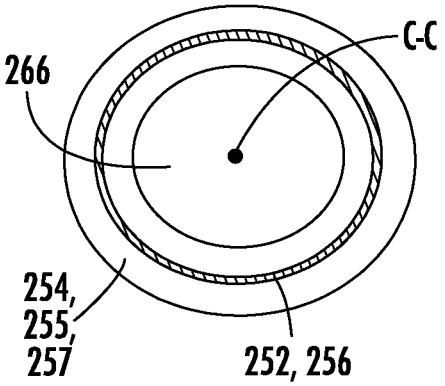
FIG. 9 illustrates an end view of the duct coupler as viewed from the first end of the engagement portion of the duct coupler shown in FIG. 7.

The head portion 254 shown in FIGS. 7-9 is an annular ring 255 that has first 257 and second annular surfaces 259 that are axially spaced apart from each other. The second end 258 of the engagement portion 252 is coupled to the first annular surface 257, and an outer diameter of the annular ring 255 of the head portion 254 is greater than an outer diameter of the second end 258 of the engagement portion 252. A central axis of the annular ring 255 is coaxial with the axis C-C of the engagement portion 252. The first annular surface 257 of the head portion 254 is axially spaced apart from the surface 231 of the first concrete structural element 230, and a portion of the wall 260 of the engagement portion 252 adjacent the second end 258 of the engagement portion 252 is disposed within the joint 215.

Figure 10:
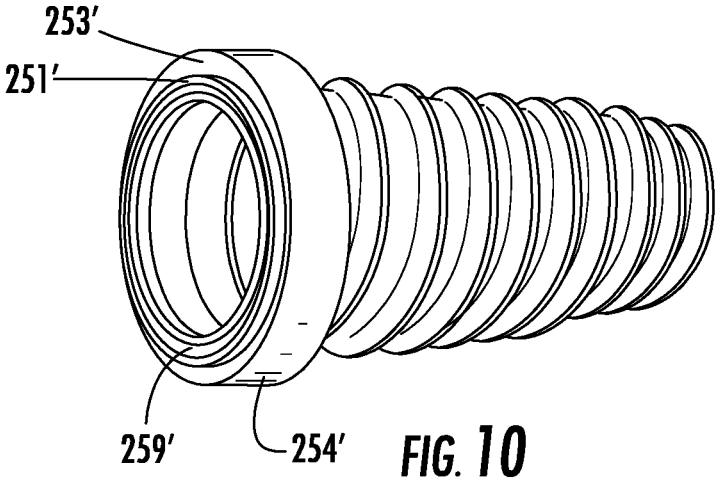
FIG. 10 illustrates a side perspective view of a duct coupler that is similar to the duct coupler in FIG. 7 but includes a head portion according to another implementation.

The second annular surface 259 of the head portion 254 comprises a compressible material for sealing against the surface 221 of the second concrete structural element 220. For example, in the implementation shown in FIGS. 7-9, the head portion 254 itself is formed of a compressible material (e.g., rubber, polyurethane). In another implementation of head portion 254' shown in FIG. 10, the head portion 254' is formed of a compressible material, and the second annular surface 259' of head portion 254' defines an axially and circumferentially oriented and groove 253' and axially and circumferentially oriented ring 251'. The groove 253' is radially adjacent the ring 251' and allows the material of the ring 251' to compress into the groove 253' when the second annular surface 259' is abutted against the surface 221 of the second concrete structural element 220. In other implementations, the head portion 254 may be formed of any material and define an axially oriented groove into which a compressible seal is disposed. The compressible seal extends axially out of a plane defined by the second annular surface 259 of the head portion 254 prior to engagement with the surface 221, and the seal compresses and expands radially against the surface 221 of the second concrete structural element 220 when the second annular surface 259 is abutted against the surface 221.

The head portions and engagement portions of the duct couplers may be formed from different materials and coupled together (e.g., after forming the portions or during casting of one or both of the portions) or integrally formed.

The duct coupler 250 is rotated in a second direction about axis C-C to urge the second annular surface 259 of the head portion 254 against the surface 221 of the second concrete structural element 220. The second direction is opposite the first direction. The axis C-C of the channel 266 of the duct coupler 250 is coaxial with the axis extending through the ducts 222A, 222B and the splice duct 223. The compressible material of the head portion 254 creates a sealed interface against the surface 221.

Figure 11:
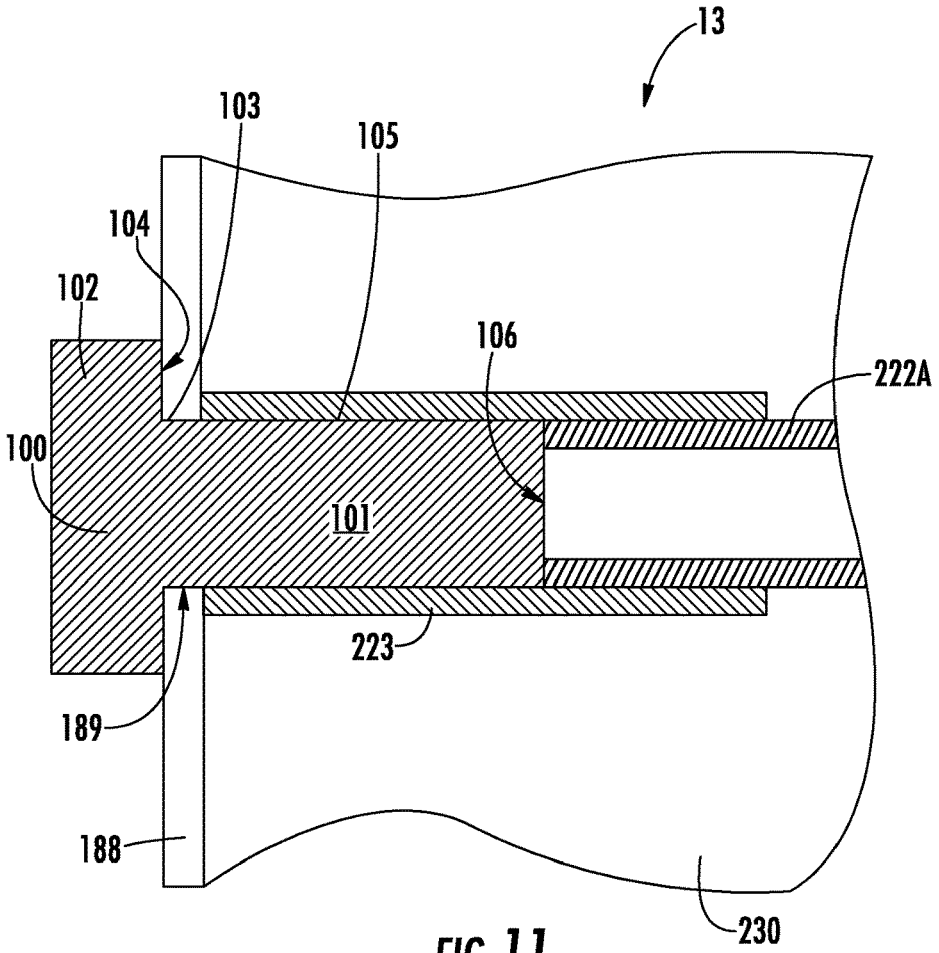
FIG. 11 illustrates a side cross sectional view of a casting apparatus according to another implementation for forming the portion of the first concrete structural element that is partially shown in FIG. 7.
Figure 12:
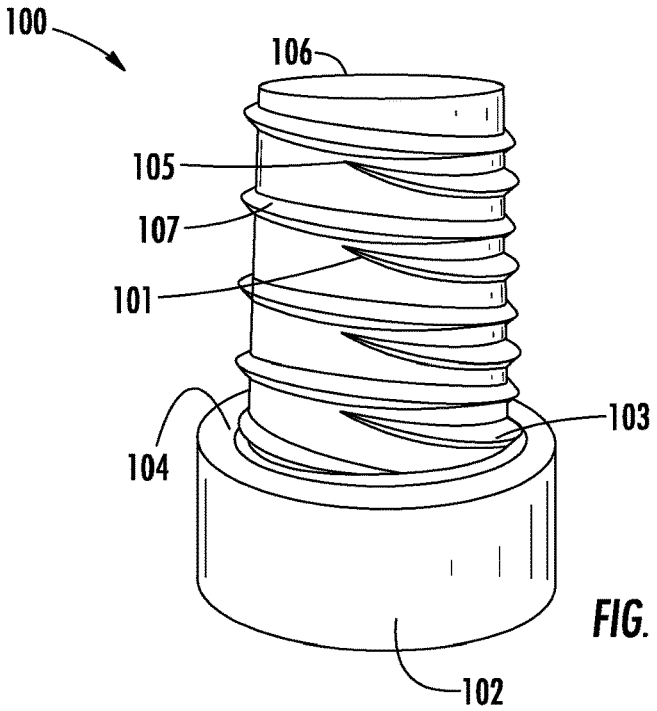
FIG. 12 illustrates a side perspective view of the duct holder shown in FIG. 11.

FIGS. 11 and 12 illustrate a partial view of a casting apparatus 13 according to another implementation that can be used to hold the splice duct 223 and duct 222A in place during the forming of the first concrete structural element 230. The casting apparatus 13 includes a duct holder 100 and a form 188 that defines a closed perimeter. A wall of the form 188 defines an opening 189. The duct holder 100 comprises a first portion 101 that engages the splice duct 223 within the form 188 and a second portion 102 that abuts an external wall of the form 188 adjacent the opening 189. In particular, the first portion 101 includes a first end 106, a second end 103 that is axially spaced apart from the first end 106, an external surface 105 that extends between the first 106 and second ends 103, and protrusions 107 that extend radially outwardly from the external surface 105 at least adjacent the first end 106. The second portion 102 has a diameter that is larger than a diameter of the second end 103 of the first portion 101 and a first surface 104 that abuts the wall of the form 188 adjacent the opening 189. The first portion 101 of the duct holder 100 is engaged through the opening 189 and into the second end 227 and the channel 234 defined by the splice duct 223. The protrusions 107 of the first portion 101 are helical threads and threadingly engage the recesses defined by the internal surface 229 of the splice duct 223. Prior to engaging the duct holder 100 with the splice duct 223, the second end 225A of the duct 222A is threadingly engaged with the internal surface 229 of the splice duct 223 through the first end 279 and the channel 234 of the splice duct 223. Then, the splice duct 223 and the duct 222A are disposed within the form 188 such that the second end 227 of the splice duct 223 is disposed against the internal surface of the wall of the form 188 adjacent the opening 189. By engaging the first portion 101 of the duct holder 100 through the opening 189 in the wall of the form 188 and with the splice duct 223, a central axis of the first portion 101 of the duct holder 100 is coaxial with the axis of the splice duct 223 and the duct 222A, and the duct holder 100 prevents movement of the splice duct 223 and duct 222A within the form 188. Concrete can then be poured into the form 188 such that the duct 222A and the splice duct 223 are embedded within the concrete. The duct holder 100 is removed from the splice duct 223 and the form 188 after the concrete hardens.

In the implementations shown, the duct holders 80, 90, 100 may be formed of a compressible material (e.g., rubber, polyurethane) or a stiff material (e.g., metal or plastic). However, in other implementations, other suitable materials may be used.

In the implementations described above, the duct couplers, duct holders, ducts, and splice duct have a circular cross-sectional shape as viewed in a plane that is orthogonal to the central axis of each structural element. However, in other implementations, the cross-sectional shape of one or more of these structural elements may be oval shaped or polygonal shaped (e.g., triangular, rectangular).

The terminology used herein is for the purpose of describing particular implementations only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of any means or step plus function elements in the claims below are intended to include any structure, material, or act for performing the function in combination with other claimed elements as specifically claimed. The implementations of the description herein have been presented for purposes of illustration and description, but are not intended to be exhaustive or limited to the form disclosed. Many modifications and variations will be apparent to those of ordinary skill in the art without departing from the scope and spirit of the implementations disclosed herein.

The invention claimed is:

1. An apparatus comprising:

a first concrete structural element comprising a first duct that is pre-cast therein, the first duct having an end adjacent a second surface of the first concrete structural element, at least a portion of a surface of the first duct adjacent the end comprises a first coupling portion;

a second concrete structural element comprising a second duct that is pre-cast therein, the second duct having an end adjacent a first surface of the second concrete structural element, wherein the second surface of the first concrete structural element and the first surface of the second concrete structural element face each other and are spaced apart, the first and second surfaces defining a joint therebetween; and a duct coupler comprising an engagement portion, the engagement portion having a first end, a second end, and at least one wall extending between the first and second ends, wherein a central axis of the duct coupler extends between the first and second ends, and the at least one wall has an internal surface and an external surface, the internal surface faces the central axis of the duct coupler and defines a channel that extends between openings defined by the first end and the second end of the duct coupler, and at least a portion of the wall adjacent the first end of the duct coupler comprises a second coupling portion, wherein the second coupling portion is coupled to the first coupling portion to couple the first duct and the duct coupler, and the second end of the engagement portion is disposed closer to the first surface of the second concrete structural element than the first end of the engagement portion, wherein the first and second ducts and the at least one wall are annular shaped, and wherein the duct coupler further comprises a head portion comprising an annular ring having first and second annular surfaces, the first and second annular surfaces being axially spaced apart along a central axis of the annular ring, wherein the first annular surface of the head portion is coupled to the second end of the engagement portion, the second annular surface of the head portion is coupled to the first surface of the second concrete structural element, an outer diameter of the annular ring is greater than an outer diameter of the second end of the engagement portion, and the central axis of the head portion is coaxial with the central axis of the channel of the engagement portion and central axes of the first and second ducts.

2. The apparatus of claim 1, wherein the first surface of the second concrete structural element and the second duct define an opening, the outer diameter of the annular ring is greater than a diameter of the opening, and the second annular surface of the head portion abuts the first surface of the second concrete structural element when the duct coupler is coupled to the first duct and extends through the joint.

3. The apparatus of claim 2, wherein the second annular surface of the head portion comprises a compressible material that abuts and creates a sealed interface against the first surface of the second concrete structural element.

4. The apparatus of claim 1, wherein the second annular surface of the head portion defines a groove comprising a compressible material, the groove allowing the compressible material radially adjacent the groove to compress when abutted against the first surface of the second concrete structural element and create a sealed interface between the head portion and the first surface of the second concrete structural element.

5. The apparatus of claim 1, wherein the head portion and the engagement portion are formed from different materials and coupled together.

6. The apparatus of claim 1, wherein the second coupling portion comprises one or more protrusions that extend radially inwardly from at least a portion of the internal surface of the annular shaped wall of the duct coupler, and the first coupling portion comprises one or more recesses defined by an external surface of the first duct, the one or more protrusions engaging the one or more recesses.

7. The apparatus of claim 6, wherein the one or more protrusions are helical threads.

8. The apparatus of claim 1, wherein the second coupling portion comprises one or more protrusions that extend radially outwardly from at least a portion of the external surface of the annular shaped wall, and the first coupling portion comprises one or more recesses defined by an internal surface of the first duct, the one or more protrusions engaging the one or more recesses.

9. The apparatus of claim 1, wherein the external surface of the annular shaped wall of the engagement portion tapers from the second end to the first end of the engagement portion such that a diameter of the external surface of the engagement portion at the second end is greater than a diameter of the external surface of the engagement portion at the first end.

10. The apparatus of claim 9, wherein a diameter of the internal surface of the annular shaped wall is constant.

11. An apparatus comprising:

a first concrete structural element comprising a first duct that is pre-cast therein, the first duct having an end adjacent a second surface of the first concrete structural element, at least a portion of a surface of the first duct adjacent the end comprises a first coupling portion;

a second concrete structural element comprising a second duct that is pre-cast therein, the second duct having an end adjacent a first surface of the second concrete structural element, wherein the first surface of the second concrete structural element and the second surface of the first concrete structural element face each other and are spaced apart, the first and second surfaces defining a joint therebetween; and a duct coupler comprising an engagement portion, the engagement portion having a first end, a second end, and at least one wall extending between the first and second ends, wherein a central axis of the duct coupler extends between the first and second ends, and the at least one wall has an internal surface and an external surface, the internal surface faces the central axis of the duct coupler and defines a channel that extends between openings defined by the first end and the second end of the duct coupler, and at least a portion of the wall adjacent the first end of the duct coupler comprises a second coupling portion, wherein the second coupling portion is coupled to the first coupling portion to couple the first duct and the duct coupler, and the second end of the engagement portion is disposed closer to the first surface of the second concrete structural element than the first end of the engagement portion, wherein the first and second ducts and the at least one wall are annular shaped, wherein the second coupling portion comprises one or more protrusions that extend radially outwardly from at least a portion of the external surface of the annular shaped wall, and the first coupling portion comprises one or more recesses defined by an internal surface of the first duct, the one or more protrusions engaging the one or more recesses, and wherein the one or more protrusions are helical threads.

12. The apparatus of claim 11, wherein the duct coupler further comprises a head portion comprising an annular ring having first and second annular surfaces, the first and second annular surfaces being axially spaced apart along a central axis of the annular ring, wherein the first annular surface of the head portion is coupled to the second end of the engagement portion, the second annular surface of the head portion is coupled to the first surface of the second concrete structural element, an outer diameter of the annular ring is greater than an outer diameter of the second end of the engagement portion, and the central axis of the head portion is coaxial with the central axis of the channel of the engagement portion and central axes of the first and second ducts.

13. An apparatus comprising:

a first concrete structural element comprising a first duct that is pre-cast therein, the first duct having an end adjacent a second surface of the first concrete structural element, at least a portion of a surface of the first duct adjacent the end comprises a first coupling portion;

a second concrete structural element comprising a second duct that is pre-cast therein, the second duct having an end adjacent a first surface of the second concrete structural element, wherein the first surface of the second concrete structural element and the second surface of the first concrete structural element face each other and are spaced apart, the first and second surfaces defining a joint therebetween;

a duct coupler comprising an engagement portion, the engagement portion having a first end, a second end, and at least one wall extending between the first and second ends, wherein a central axis of the duct coupler extends between the first and second ends, and the at least one wall has an internal surface and an external surface, the internal surface faces the central axis of the duct coupler and defines a channel that extends between openings defined by the first end and the second end of the duct coupler, and at least a portion of the wall adjacent the first end of the duct coupler comprises a second coupling portion; and a splice duct, the splice duct having a first end and a second end that is axially spaced apart from the first end, the splice duct further comprising an internal surface that faces a central axis of the splice duct that extends between the first and second ends, the internal surface comprising a third coupling portion and a fourth coupling portion, wherein the third coupling portion is adjacent the first end of the splice duct and engages the first coupling portion of the first duct, and the fourth coupling portion is adjacent the second end of the splice duct and engages the second coupling portion of the duct coupler, wherein the first duct and the duct coupler are coupled via the splice duct and the second end of the splice duct is closer to the facing surface of the first concrete structural element than the first end of the splice duct, wherein the second coupling portion is coupled to the first coupling portion to couple the first duct and the duct coupler, and the second end of the engagement portion is disposed closer to the first surface of the second concrete structural element than the first end of the engagement portion, and wherein the first and second ducts and the at least one wall are annular shaped.

14. The apparatus of claim 13, wherein each of the first and second coupling portions comprises one or more protrusions that extend radially outwardly from an external surface of the first duct and the external surface of the duct coupler, respectively, and each of the third and fourth coupling portions comprise one or more recesses that are defined by the internal surface of the splice duct, wherein the one or more protrusions of the first coupling portion engage the one or more recesses of the third coupling portion, and the one or more protrusions of the second coupling portion engage the one or more recesses of the fourth coupling portion.

15. The apparatus of claim 14, wherein the one or more protrusions are helical threads.

16. A duct coupler for extending between a first duct that is pre-cast within a first concrete structural element and a second duct that is pre-cast within a second concrete structural element, the duct coupler comprising:

an engagement portion for coupling with the first duct, the engagement portion having a first end, a second end, and at least one wall extending between the first and second ends, wherein a central axis extends between the first and second ends, wherein the at least one wall has an internal surface and an external surface, the internal surface faces the central axis and defines a channel that extends between openings defined by the first end and the second end, and at least a portion of the wall adjacent the first end comprises a coupling portion, wherein the at least one wall is an annular shaped wall; and a head portion comprising an annular ring having a first annular surface and a second annular surface, the first and second annular surfaces being axially spaced apart along a central axis of the annular ring, wherein the first annular surface of the head portion is coupled to the second end of the engagement portion, the second annular surface of the head portion is coupled to the first surface of the second concrete structural element, the central axis of the head portion is coaxial with the central axis of the channel of the engagement portion and central axes of the first and second ducts, and an outer diameter of the annular ring is greater than an outer diameter of the second end of the engagement portion.

17. The duct coupler of claim 16, wherein the coupling portion comprises one or more protrusions that extend radially inwardly from at least a portion of the internal surface of the annular shaped wall, the one or more protrusions for engaging one or more recesses defined on an external surface of the first duct.

18. The duct coupler of claim 17, wherein the one or more protrusions are helical threads.

19. A duct coupler for extending between a first duct that is pre-cast within a first concrete structural element and a second duct that is pre-cast within a second concrete structural element, the duct coupler comprising:

an engagement portion for coupling with the first duct, the engagement portion having a first end, a second end, and at least one wall extending between the first and second ends, wherein a central axis extends between the first and second ends, wherein the at least one wall has an internal surface and an external surface, the internal surface faces the central axis and defines a channel that extends between openings defined by the first end and the second end, and at least a portion of the wall adjacent the first end comprises a coupling portion, wherein the at least one wall is an annular shaped wall, wherein the coupling portion comprises one or more protrusions that extend radially outwardly from at least a portion of the external surface of the annular shaped wall, the one or more protrusions for engaging one or more recesses defined by an internal surface of the first duct, and wherein the one or more protrusions are helical threads.

20. The duct coupler of claim 17, further comprising a head portion comprising an annular ring having a first annular surface and a second annular surface, the first and second annular surfaces being axially spaced apart along a central axis of the annular ring, wherein the first annular surface of the head portion is coupled to the second end of the engagement portion, the second annular surface of the head portion is coupled to the first surface of the second concrete structural element, the central axis of the head portion is coaxial with the central axis of the channel of the engagement portion and central axes of the first and second ducts, and an outer diameter of the annular ring is greater than an outer diameter of the second end of the engagement portion.

21. A duct coupler for extending between a first duct that is pre-cast within a first concrete structural element and a second duct that is pre-cast within a second concrete structural element, the duct coupler comprising:

an engagement portion for coupling with the first duct, the engagement portion having a first end, a second end, and at least one wall extending between the first and second ends, wherein a central axis extends between the first and second ends, wherein the at least one wall has an internal surface and an external surface, the internal surface faces the central axis and defines a channel that extends between openings defined by the first end and the second end, and at least a portion of the wall adjacent the first end comprises a coupling portion, wherein the at least one wall is an annular shaped wall, wherein the coupling portion comprises one or more protrusions that extend radially outwardly from at least a portion of the external surface of the annular shaped wall, the one or more protrusions for engaging one or more recesses defined by an internal surface of a splice duct that is coupled to the first duct, and wherein the one or more protrusions are helical threads.

22. The duct coupler of claim 19, further comprising a head portion comprising an annular ring having a first annular surface and a second annular surface, the first and second annular surfaces being axially spaced apart along a central axis of the annular ring, wherein the first annular surface of the head portion is coupled to the second end of the engagement portion, the second annular surface of the head portion is coupled to the first surface of the second concrete structural element, the central axis of the head portion is coaxial with the central axis of the channel of the engagement portion and central axes of the first and second ducts, and an outer diameter of the annular ring is greater than an outer diameter of the second end of the engagement portion.

* * * * *